US006799660B1

(12) United States Patent
Crawford

(10) Patent No.: US 6,799,660 B1
(45) Date of Patent: Oct. 5, 2004

(54) STEP LADDER DEVICE

(76) Inventor: James R. Crawford, 6 Wampum Trail, Ridge, NY (US) 11961

( * ) Notice: Subject to any disclaimer, the term of this patent is extended or adjusted under 35 U.S.C. 154(b) by 0 days.

(21) Appl. No.: 10/328,905

(22) Filed: Dec. 26, 2002

(51) Int. Cl.[7] ..... E06C 1/00; E04G 5/02

(52) U.S. Cl. ..... 182/200; 182/108; 182/172; 248/188.3

(58) Field of Search ..... 182/200, 204, 182/108, 171, 172, 107, 173, 166; 248/188.3, 188.2

(56) References Cited

U.S. PATENT DOCUMENTS

| | | | | | |
|---|---|---|---|---|---|
| 1,294,345 | A | | 2/1919 | Maxwell | |
| 3,406,785 | A | | 10/1968 | Pilcher | |
| 4,069,893 | A | | 1/1978 | Blackstone | |
| 4,090,586 | A | * | 5/1978 | Pears | 182/204 |
| 4,244,446 | A | * | 1/1981 | Mair | 182/172 |
| 4,641,729 | A | * | 2/1987 | Beck et al. | 182/172 |
| 4,899,849 | A | * | 2/1990 | Levi et al. | 182/172 |
| 4,995,474 | A | * | 2/1991 | Gauthier | 182/201 |
| 5,148,892 | A | * | 9/1992 | Lu | 182/201 |
| 5,462,133 | A | * | 10/1995 | Merrill et al. | 182/172 |
| 5,551,529 | A | | 9/1996 | Molitor | |
| 5,868,222 | A | * | 2/1999 | Charbonneau | 182/172 |
| D419,243 | S | | 1/2000 | Goch | |
| 6,065,566 | A | * | 5/2000 | Brown et al. | 182/172 |
| 6,167,989 | B1 | * | 1/2001 | Jung | 182/172 |
| 6,250,466 | B1 | * | 6/2001 | Ernst | 206/378 |

* cited by examiner

*Primary Examiner*—Hugh B. Thompson, II

(57) ABSTRACT

A step ladder device for balancing and stabilizing a ladder upon most any surface. The step ladder device includes a ladder having pairs of side rails and rung members being attached to the pairs of side rails; and also includes a ladder support assembly having leg assemblies including leg support members being attached to bottom ends of the side rails, and also including leg members being adjustably attached to the leg support members, and further including feet members being pivotally attached to the leg members.

4 Claims, 5 Drawing Sheets

STEP LADDER DEVICE

BACKGROUND OF THE INVENTION

1. Field of the Invention

The present invention relates to ladder stabilizers and more particularly pertains to a new step ladder device for balancing and stabilizing a ladder upon most any surface.

2. Description of the Prior Art

The use of ladder stabilizers is known in the prior art. More specifically, ladder stabilizers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,406,785; 5,551,529; 1,294,345; 4,069,893; and Des. 419,243.

While these devices fulfill their respective, particular objectives and requirements, the aforementioned patents do not disclose a new step ladder device. The prior art includes leg members attached to the ladders for the stabilization thereof.

SUMMARY OF THE INVENTION

The general purpose of the present invention, which will be described subsequently in greater detail, is to provide a new step ladder device which has many of the advantages of the ladder stabilizers mentioned heretofore and many novel features that result in a new step ladder device which is not anticipated, rendered obvious, suggested, or even implied by any of the prior art ladder stabilizers, either alone or in any combination thereof. The present invention includes a ladder having pairs of side rails and rung members being attached to the pairs of side rails; and also includes a ladder support assembly having leg assemblies including leg support members being attached to bottom ends of the side rails, and also including leg members being adjustably attached to the leg support members, and further including feet members being pivotally attached to the leg members. None of the prior art includes the combination of elements described in the present invention.

There has thus been outlined, rather broadly, the more important features of the step ladder device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new step ladder device which has many of the advantages of the ladder stabilizers mentioned heretofore and many novel features that result in a new step ladder device which is not anticipated, rendered obvious, suggested, or even implied by any of the prior art ladder stabilizers, either alone or in any combination thereof.

Still another object of the present invention is to provide a new step ladder device for balancing and stabilizing a ladder upon most any surface.

Still yet another object of the present invention is to provide a new step ladder device that is easy and convenient to attach and use.

Even still another object of the present invention is to provide a new step ladder device that prevents the ladder from slipping upon a surface and also from falling over thus preventing injury to the user thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
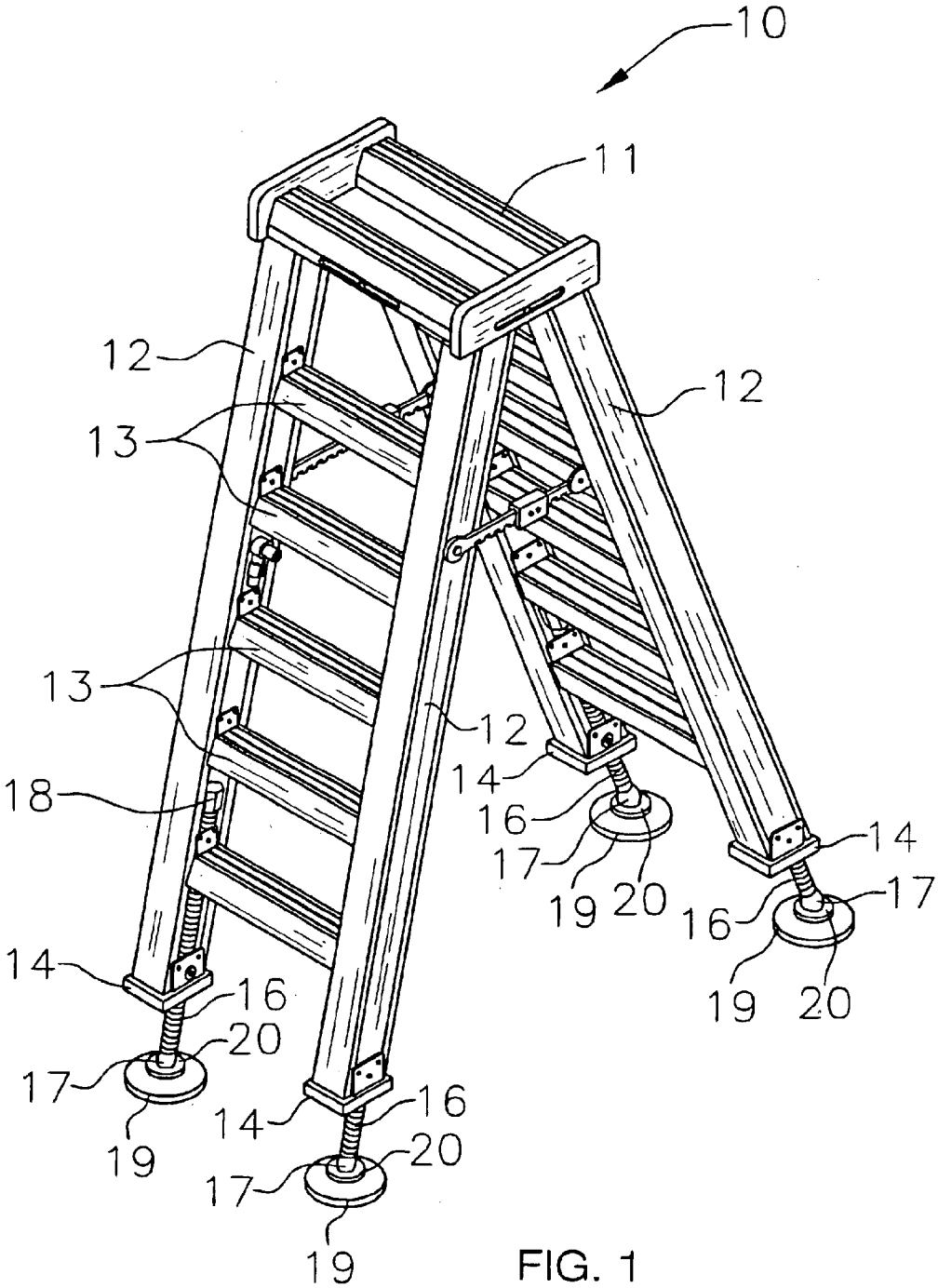
FIG. 1 is a perspective view of a new step ladder device according to the present invention.
Figure 2:
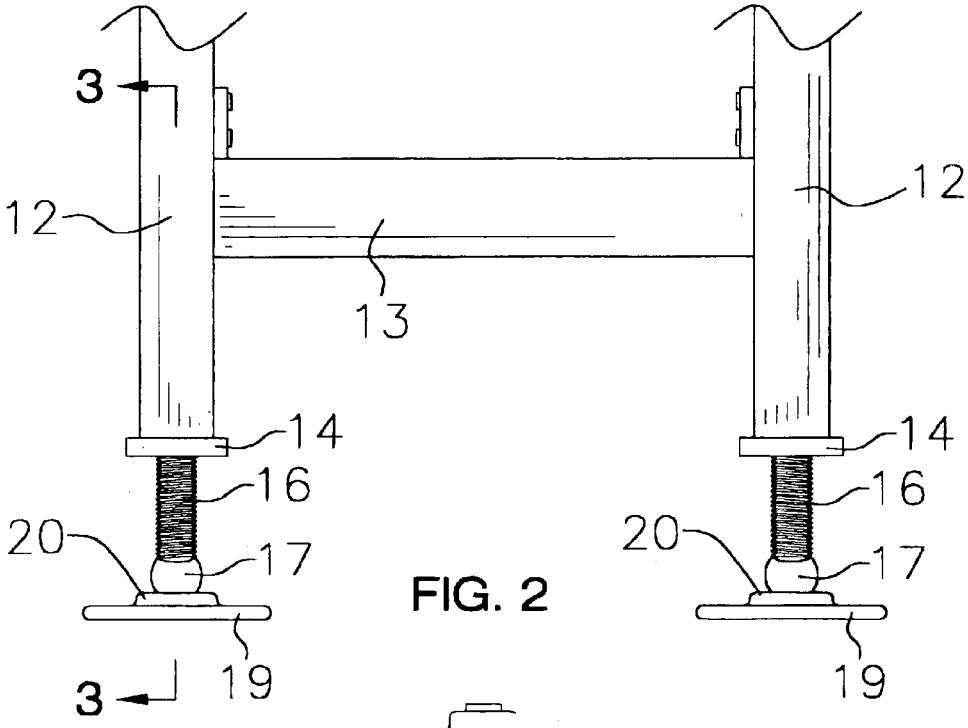
FIG. 2 is a front elevational view of the present invention shown in use.
Figure 3:
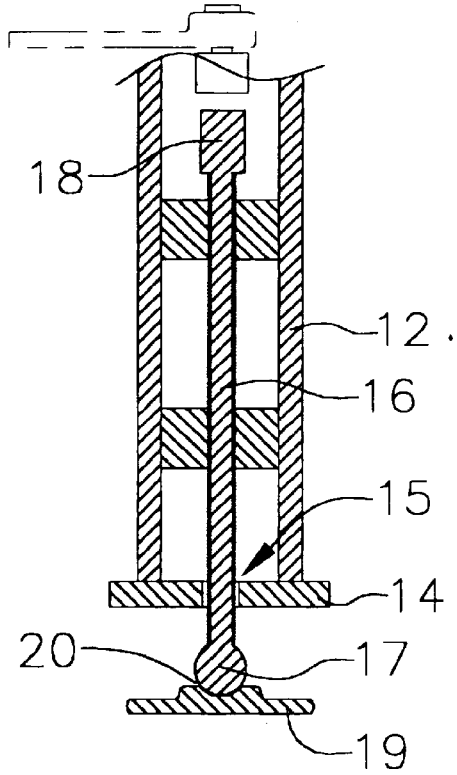
FIG. 3 is a cross-sectional view of one of the support members of the present invention.
Figure 4:
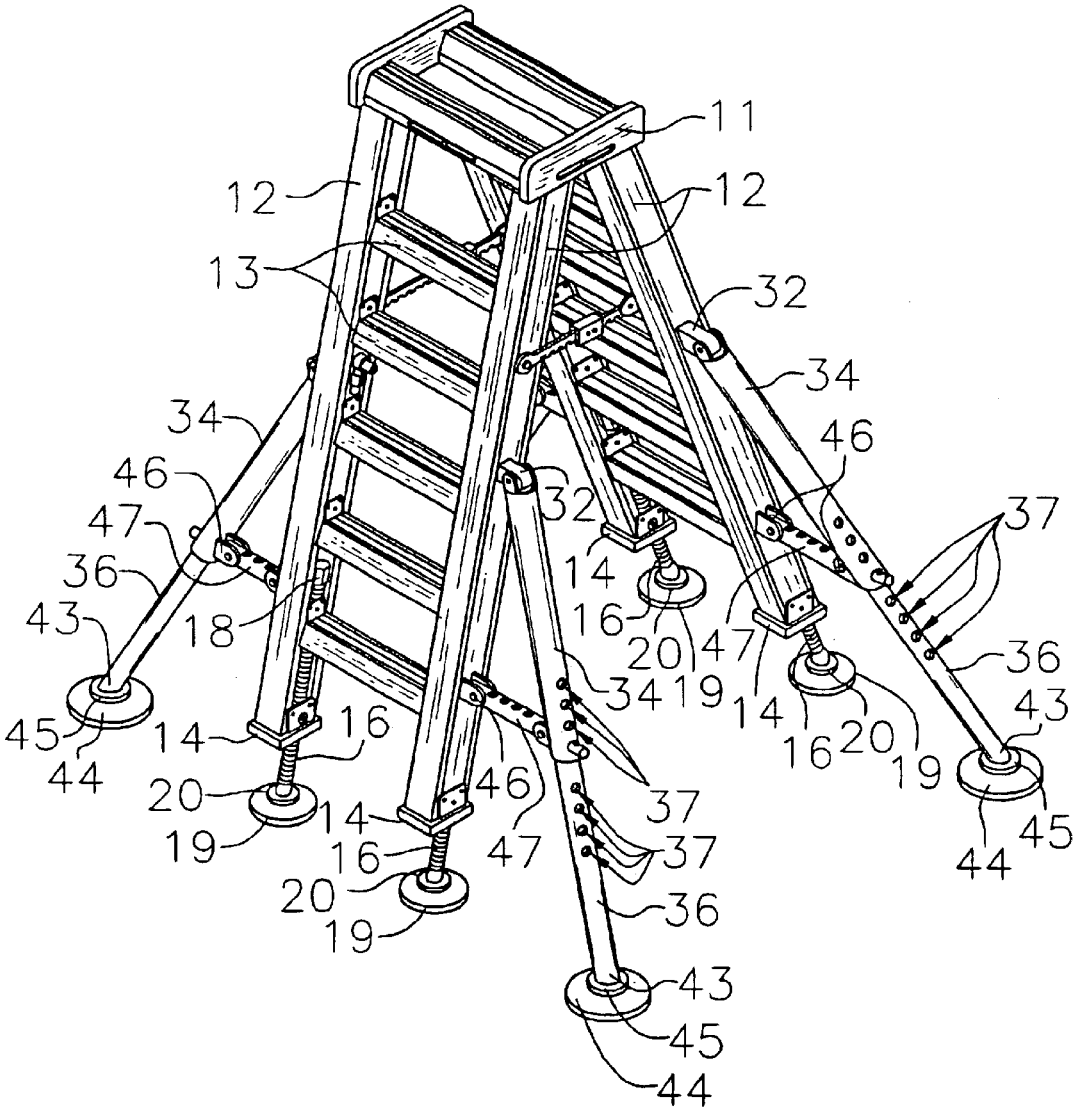
FIG. 4 is a perspective view of a second embodiment of the present invention.
Figure 5:
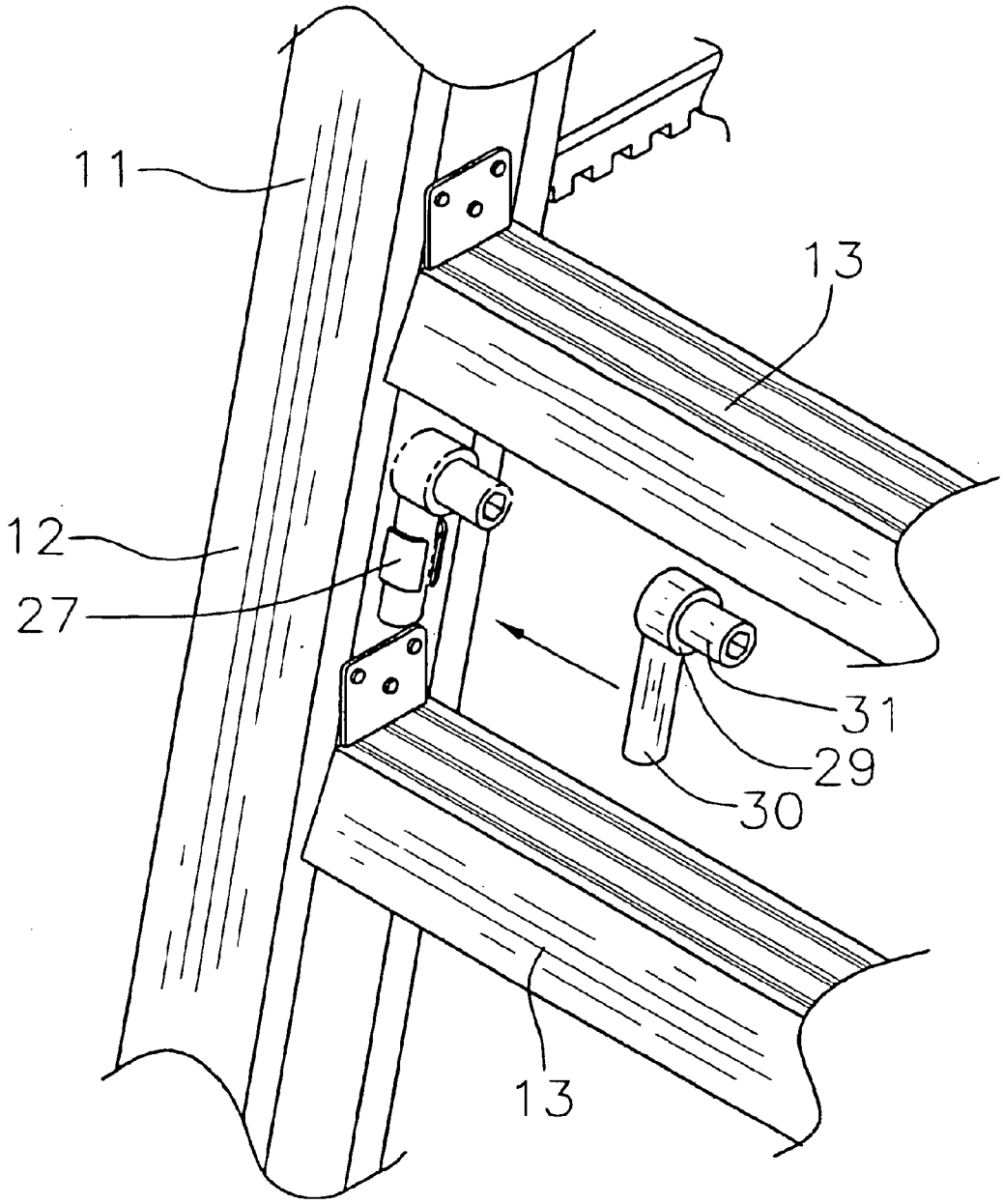
FIG. 5 is a detailed perspective view of a wrench and wrench holder of the present invention.
Figure 6:
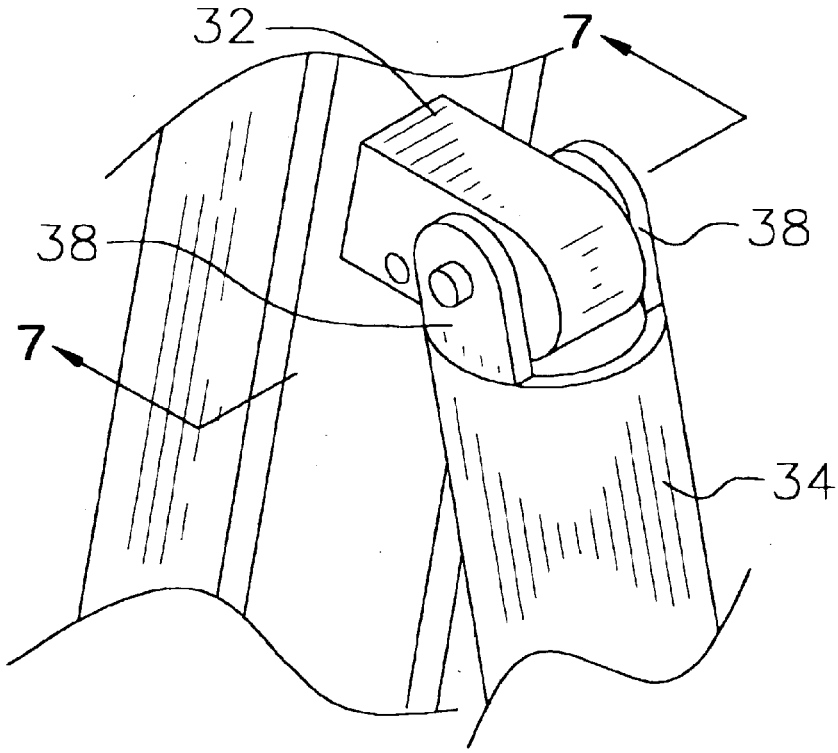
FIG. 6 is a detailed perspective view of one of the hinge members of the second embodiment of the present invention.
Figure 7:
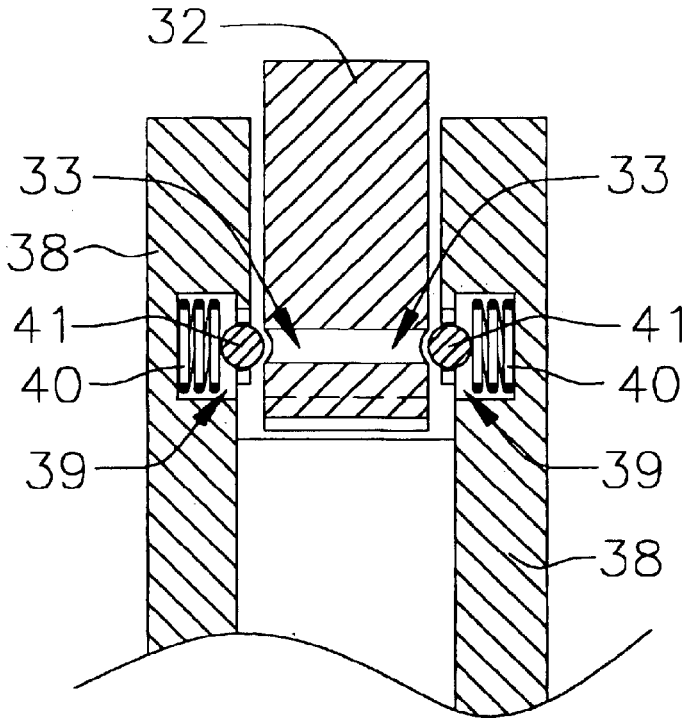
FIG. 7 is a detailed cross-sectional view of one of the hinge members and support members of the second embodiment of the present invention.

With reference now to the drawings, and in particular to FIGS. 1 through 7 thereof, a new step ladder device embodying the principles and concepts of thee present invention and generally designated by the reference numeral 10 will be described.

As best illustrated in FIGS. 1 through 7, the step ladder device 10 generally comprises a ladder 11 having pairs of side rails 12 and rung members 13,14 being conventionally attached to the pairs of side rails 12. The rung members 13,14 include a pair of bottom rung members 14 having bores 15 being spaced apart and extending therethrough from a top side to a bottom side thereof.

A ladder support assembly has leg assemblies including leg support members 14 being conventionally attached to bottom ends of the side rails 12, and also including leg members 16 being adjustably attached to the leg support members 14, and further including feet members 19 being pivotally and conventionally attached to the leg members 16. Each of the leg members 16 has a ball-shaped bottom end 17 and a multi-sided top end 18 for easy adjustment thereof. Each of the feet members 19 has a concave joint 20 being conventionally disposed thereupon. Each of the ball-shaped bottom ends 18 of a respective leg member 16 is pivotally and conventionally seated in the concave joint 20 of a respective feet member 19. Each of the leg support members 14 is a plate having a hole 15 being centrally-disposed therethrough. Each of the leg members 16 has external threads extending a length thereof and is threaded through the hole 15 of a respective leg support member 14. The ladder support assembly further includes a tool holder 27 being conventionally attached to one of the side rails 12 of the ladder 11, and also includes a socket wrench 29 being removably held by the tool holder 27 and having a handle portion 30 and socket portion 31 for engaging about the multi-sided top ends 18 of the leg members 16.

As a second embodiment the ladder support assembly also includes hinge members 32 being conventionally attached to outer sides of the side rails 12 of the ladder 11, and having opposed slots 33 being disposed in sides thereof with the leg assemblies being pivotally attached to the hinge members 32. Each of the leg assemblies further includes an elongate tubular member 34 being hingedly attached to a respective hinge member 32, and also includes an elongate extension member 36 having a ball-shaped bottom end 43 and being telescopingly received in and extended from the elongate tubular member 34, and further includes support feet 44 having concave joint members 45 being conventionally disposed thereupon for conventionally receiving the ball-shaped bottom ends 43 of the elongate extension members 36, and also includes bracket members 38 being conventionally attached to a top end of the elongate tubular member 34 and being fastenable to a respective hinge member 32, and further includes a fastener 42 for fastening the elongate extension member 36 to the elongate tubular member 34. Each of the elongate tubular members 34 has a plurality of holes 35 being spacedly disposed through and along a length of a side wall of the elongate tubular member 34. Each of the elongate extension members 36 has a plurality of holes 37 being spaced disposed in and along a length of a side wall thereof with the fasteners 42 being insertable in the holes 35,37 of the elongate tubular members 34 and the elongate extension members 36. Each of the bracket members 38 has a slot 39 disposed therein. The ladder support assembly further includes spring members 40 being conventionally disposed in the slots 39 of the bracket members 38, and also includes balls 41 being conventionally attached to the spring members 40 and being removably disposed in the slots 33 of the hinge members 32 to securely and removably attach the leg assemblies to the hinge members 32.

In use, the user sets up the ladder 11 and adjusts the leg members 16 so that the feet members 20 rest upon the particular surface, and the user also pivots the elongate tubular members 34 and extends the elongate extension members 36 from the elongate tubular members 34 so that the support feet 44 are in contact with the surface to prevent the ladder 11 from sliding upon the surface and toppling over as the user climbs thereupon.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the step ladder device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A step ladder device comprising:

a ladder having pairs of side rails and rung members being attached to said pairs of side rails;

a ladder support assembly having leg assemblies including leg support members being attached to bottom ends of said side rails, and also including leg members being adjustably attached to said leg support members, and further including feet members being pivotally attached to said leg members, each of said leg members having a ball-shaped bottom end, and each of said feet members having a concave joint being disposed thereupon, each of said ball-shaped bottom ends of a respective said leg member being pivotally seated in said concave joint of a respective said feet member, said ladder support assembly also including leg stopper members being attached to top ends of said leg members to prevent said leg members from being removed from said leg support members, each of said leg support members being a plate having a hole being centrally-disposed therethrough, each of said leg members having external threads extending a length thereof and being threaded through said hole of a respective said leg support member, said ladder support assembly further includes including a tool holder being attached to one of said side rails of said ladder, and also includes including a socket wrench being removably held by said tool holder and having a handle portion and socket portion, said ladder support assembly also including hinge members being attached to outer sides of said side rails of said ladder and having opposed slots disposed in sides thereof, and further including leg assemblies being pivotally attached to said hinge members, each of said leg assemblies further including an elongate tubular member being hingedly attached to a respective said hinge member, and also including an elongate extension member having a ball-shaped bottom end and being telescopingly received in and extended from said elongate tubular member, and further including support feet having concave joint members being disposed thereupon for receiving said ball-shaped bottom ends of said elongate extension members, and further including bracket members being attached to a top end of said elongate tubular member and being fastenable to a respective said hinge member, and also including a fastener for fastening said elongate extension member to said elongate tubular member, each of said leg assemblies also including brace support brackets being attached to a selected said side rail and to a respective said elongate tubular member and further including an adjustable tubular brace member having ends which are fastened to said brace support brackets for stabilizing a respective said elongate tubular member and a respective said elongate extension member, each of said elongate tubular members having a plurality of holes being spacedly disposed through and along a length of a side wall of said elongate tubular member.

2. The step ladder device as described in claim 1, wherein each of said elongate extension members has a plurality of holes being spaced disposed in and along a length of a side wall thereof, said fasteners being insertable in said holes of said elongate tubular members and said elongate extension members.

3. The step ladder device as described in claim 2, wherein each of said bracket members has a slot disposed therein.

4. The step ladder device as described in claim 3, wherein said ladder support assembly further includes spring members being disposed in said slots of said bracket members, and also includes balls being attached to said spring members and being removably disposed in said slots of said hinge members to securely and removably attach said leg assemblies to said hinge members.

* * * * *